US006518890B2

(12) United States Patent
Hallén et al.

(10) Patent No.: US 6,518,890 B2
(45) Date of Patent: Feb. 11, 2003

(54) DEVICE FOR INDICATING MULTIPLE CONDITIONS

(75) Inventors: Anders Hallén, Kullavik (SE); Mohammad Moradnia, Göteborg (SE)

(73) Assignee: Volvo Personvagner AB, Göteborg (SE)

( * ) Notice: Subject to any disclaimer, the term of this patent is extended or adjusted under 35 U.S.C. 154(b) by 0 days.

(21) Appl. No.: 09/882,642

(22) Filed: Jun. 15, 2001

(65) Prior Publication Data

US 2002/0014970 A1 Feb. 7, 2002

Related U.S. Application Data

(63) Continuation of application No. PCT/SE99/02406, filed on Dec. 17, 1999.

(30) Foreign Application Priority Data

Dec. 17, 1998 (SE) ..... 9804381

(51) Int. Cl.[7] ..... G08B 3/00

(52) U.S. Cl. ..... 340/691.7; 340/686.1; 340/686.3; 340/542; 340/547; 70/262; 70/253; 70/264

(58) Field of Search ..... 340/691.7, 691, 340/686.1, 686.3, 542, 545, 547; 70/262, 263, 264

(56) References Cited

U.S. PATENT DOCUMENTS

| | | | | |
|---|---|---|---|---|
| 3,573,812 A | | 4/1971 | Pihl | |
| 3,634,857 A | | 1/1972 | Pihl | |
| 3,660,814 A | | 5/1972 | Fales | |
| 3,872,469 A | | 3/1975 | Loughran | |
| 4,131,886 A | | 12/1978 | Kosuge | |
| 4,132,986 A | * | 1/1979 | Hart et al. | 340/373 |
| 4,156,872 A | | 5/1979 | Helwig | |
| 4,268,821 A | * | 5/1981 | DeSmet | 340/373 |
| 4,912,442 A | | 3/1990 | Black | |
| 5,663,712 A | * | 9/1997 | Kamp | 340/644 |
| 5,698,906 A | | 12/1997 | Gardner et al. | |

FOREIGN PATENT DOCUMENTS

| | | | |
|---|---|---|---|
| CH | 597 604 A5 | 4/1978 | G01R/19/14 |
| CH | 597604 A5 | 4/1978 | |
| CH | 620 014 A5 | 10/1980 | E05B/65/20 |
| CH | 620014 A5 | 10/1980 | |
| DE | 444071 C1 | 2/1996 | |
| DE | 44 40 717 C1 | 2/1996 | E05B/65/38 |
| EP | 0649959 A1 | 4/1995 | E05B/65/20 |

OTHER PUBLICATIONS

International Search Report for Application No. PCT/SE99/02406, dated Apr. 17, 2000 (mailing date).
Preliminary Examination Report for Application No. PCT/SE99/02406, dated Mar. 22, 2001 (mailing date).

* cited by examiner

*Primary Examiner*—Jeffrey Hofsass
*Assistant Examiner*—Hung Nguyen
(74) *Attorney, Agent, or Firm*—Howrey Simon Arnold & White LLP

(57) ABSTRACT

A device for indicating a multi-position state and having one or more sensors, one or more bi-stable, magnetic switches, and a control unit. The switches are provided with an electromagnet arranged in connection with each individual switch thereby enabling the switches to be switched between two or more indicating positions by sending an electric pulse through the electromagnet. The sensors are connected to the control unit, which is in turn connected to the switches. The sensors are arranged to sense which of the two or more positions is the current state of a measured object, and transmit a signal corresponding to the position of the measured object to the control unit. The control unit is arranged to transmit a signal to the electromagnet of the corresponding switch in order to update the indicated state of the switch.

14 Claims, 3 Drawing Sheets

DEVICE FOR INDICATING MULTIPLE CONDITIONS

CROSS REFERENCE TO RELATED APPLICATIONS

The present application is a continuation of PCT application Ser. No. PCT/SE99/02406 filed Dec. 17, 1999, which claims priority to Swedish Application No. 9804381-3, filed Dec. 17, 1998.

BACKGROUND OF THE INVENTION

Technical Field. The present invention relates to a device for indicating a multi-position state, such as indicating a locked or open state for a vehicle door lock.

Background Information. The state of the lock, i.e., locked or open, is normally indicated by a mechanical connection between the locking mechanism of the door and the door locking knob. The locking knob is usually arranged on the upper side of the door in close proximity to the locking mechanism so that the connecting mechanism does not have to be complex. When the door lock is locked the locking knob is in a lower position, and when the door lock is open the locking knob is in an upper position. The locking knob is also used for maneuvering the lock from the open to the locked position and vice versa.

One such device for indicating the state of a door lock is disclosed in German Patent No. 44 40 717 C1. Therein a pneumatic central locking system is used whereby a pneumatic servomotor actuates a locking bolt. A pneumatic actuating hose supplies pneumatic pressure to the servomotor. The source of pneumatic pressure is either the vehicle engine or a separate motor, e.g., an electric motor. When the pressure in the actuating hose is increased the door lock is unlocked. At a certain low pressure in the actuating hose the door is locked. Hence, the rest position is a locked door, that is, when there is no pressurized air in the actuating hose. A flexible, pneumatic hose is connected to the actuating hose at a first end and to a pneumatic indicating device at a second end. The indicating device can have at least two positions—a first position when the pressure in the flexible hose is low (door lock locked), and a second position when the pressure in the flexible hose is high (door lock open). The indicating device may comprise a ball that can be pushed up from a rest position (first position) to a working position (second position) by pressurized air in the flexible hose. Alternatively, the indicating device may comprise a flexible membrane that in the rest position (first position) is placed in contact with the lower part of the indicating device and in the working position (second position) is filled with pressurized air, pushing the membrane out from the indicating device.

A drawback of the device described above occurs when there is a leak in the pneumatic system, disabling the locking function as pressurized air must be supplied constantly in order to keep the door lock in an open position. If a leak occurs when the door lock is required to remain open, it will instead become locked. For this reason, a mechanically operated back-up that is accessible from both inside and outside of the vehicle must be provided. A further possible drawback of the above device is that the system must include some kind of pressurized tank to keep the door lock open when the normal source of pressure is inoperative. If the pressurized tank is inoperative, the pneumatic opening of the lock will not work and the mechanical back-up must be used. In addition, elastic parts made of rubber or soft plastic tend to lose their elasticity during freezing conditions.

Consequently, all devices using a flexible element for indicating, such as a membrane having two positions, may experience some functional problems during periods of severe cold.

An electronic system for locking car doors is described in U.S. Pat. No. 4,744,021. A locking pin in the door is guided between two end positions by a drive motor, whereby the position of the locking pin (open/closed) is indicated by lighting a first light emitting diode (LED) when the locking pin is in the open position and a second LED when the locking pin is in the locked position. The first LED is off when the second LED is on, and vice versa. Apparent drawbacks of this solution are that LED's are less visible during the day than during the night. They also require a constant supply of voltage as long as an indication is required, contributing to vehicle battery drain. This can become a problem when the vehicle is not used over a long period of time.

SUMMARY OF THE INVENTION

A general purpose of the present invention is to provide a device for indicating a two-position state that does not require a constant supply of voltage or pressurized air for indicating the position of the lock, and which is clearly visible during the day as well as by night.

According to the present invention these purposes are achieved by an indicating device for indicating a multi-position state. The device may have one or more sensors, one or more bi-stable, magnetic switches, and a control unit. The switches are provided with at least one electromagnet arranged in connection with each individual switch, thereby enabling the switches to switch between two or more (multiple) indicating positions by sending an electric pulse through the electromagnet. The sensors are connected to the control unit, which in turn is connected to the switches. The sensors are arranged to sense which of the two or more positions is the current state of a measured object. The sensors are also arranged to transmit a signal corresponding to the position of the measured object to the control unit. The control unit is arranged to transmit a signal to the electromagnet of the corresponding switch in order to update the indicated state of the switch.

Preferred embodiments of the invention include the device described above wherein the switches also have a magnetic element having a first side and a second side, wherein the first side is provided with a first indicating means and the second side is provided with a second indicating means.

The device above may also have different colors for the first indicating means and the second indicating means. Further, either one or both of the first indicating means and the second indicating means may have a fluorescent color. The first indicating means may include a first, flat circular element and the second indicating mean may include a second, flat circular element. The first indicating means may include a first hemispherical element and the second indicating means may include a second hemispherical element. The first indicating means may include a first semi-cylindrical element and the second indicating mean may include a second semi-cylindrical element.

Another embodiment may include the device of above wherein it is arranged to indicate locked and unlocked states of a locking mechanism in a vehicle.

Another embodiment may be a vehicle including the above disclosed device.

BRIEF DESCRIPTION OF DRAWINGS

Preferred embodiments of the invention will be described in more detail below, with reference to the appended figures, wherein.

DETAILED DESCRIPTION OF THE INVENTION

Figure 1:
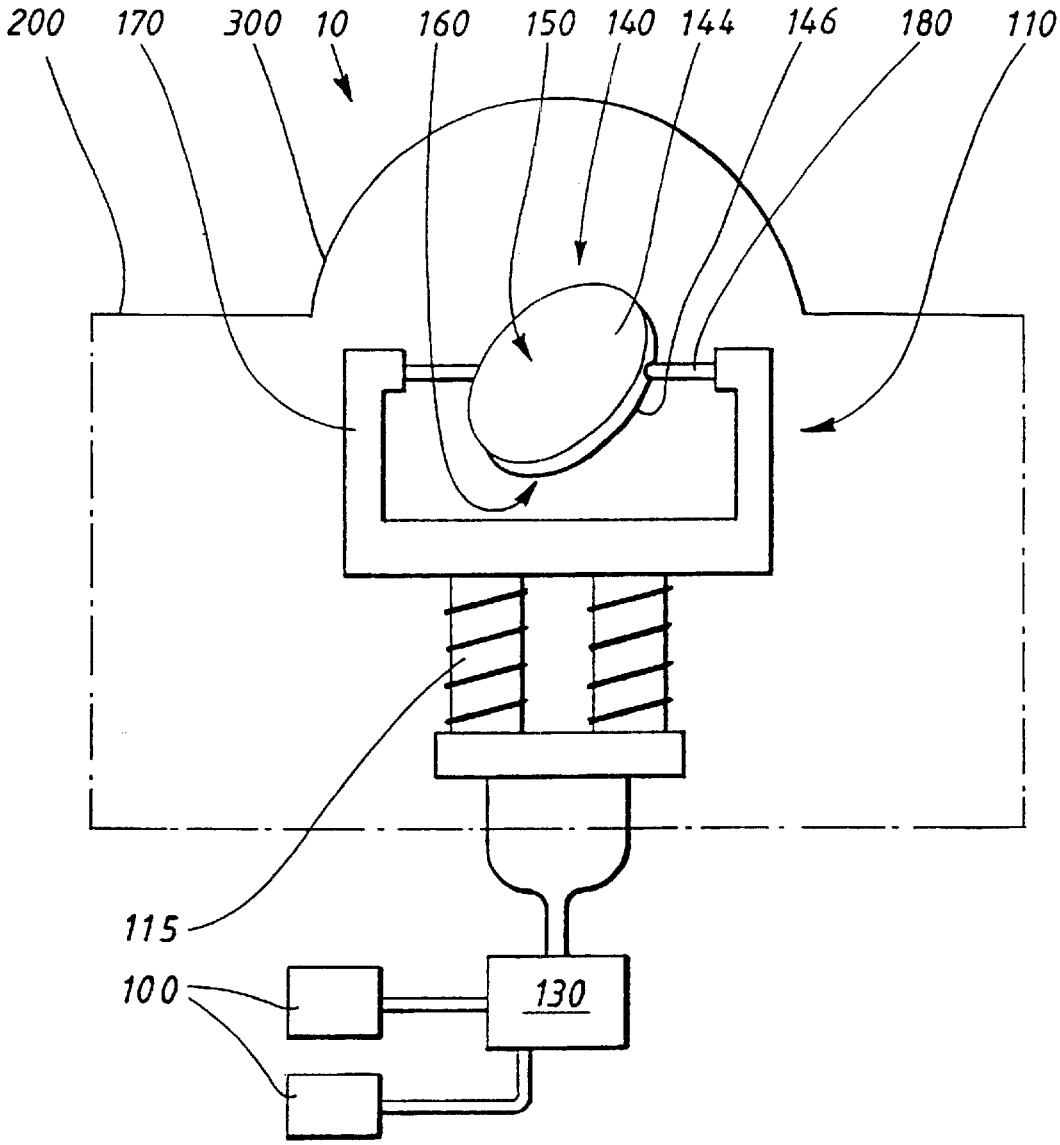
FIG. 1 is a schematic side view of one embodiment of a device for indicating a two-position state according to the invention.

FIG. 1 shows a device 10 for indicating a two-position state according to the present invention. The device comprises one or more sensors 100, one or more bistable, magnetic switches 110 and a control unit 130. The switches 110 include an electromagnet 115 arranged in connection with each individual switch 110 so that the switches 110 can be switched between two indicating positions. This is accomplished by sending an electric pulse through the electromagnet 115. Typical values for said electric pulse are 350 mA and at least 7.5 V. The sensors 100 are electrically connected to the control unit 130, and the control unit 130 is in turn electrically connected to the electromagnets 115 of the switches 110. The sensors 100 are arranged to measure the current state of an object (not shown) by sensing which of the two positions it occupies. The sensors 100 transmit a signal corresponding to the position of the measured object to the control unit 130. The control unit 130 then transmits a signal to the electromagnet 115 of the corresponding switch 110 in order to update the indicating state of the switch 110.

Each switch 110 also includes a magnetic element 140, having a first side 144 and a second side 146. The first side 144 is provided with a first indicator or indicating means 150, and the second side 146 is provided with a second indicator or indicating means 160.

The first indicating means 150 and the second indicating means 160 have different visual appearances enabling a person viewing the device to immediately recognize the position indicated. For example, the two indicating means may have different colors, preferably fluorescent colours. Alternatively, or in combination with different colors, the indicating means may use various symbols. Examples of such symbols include the international stop-symbol, the palm of a hand, or an "X". It would also be advantageous to provide a source of lighting (not shown) arranged to be lit when necessary, e.g., in darkness when the lock is to be opened or locked. The lighting device can illuminate the indicating means shown so that it is visible when dark. The lighting device may be either manually activated or automatic, e.g., connected to a central computer unit in the vehicle.

According to a preferred embodiment of the present invention, the first indicating means 150 comprises a first flat, circular element 144 and the second indicating means 150 comprises a second flat, circular element 146.

Figure 2:
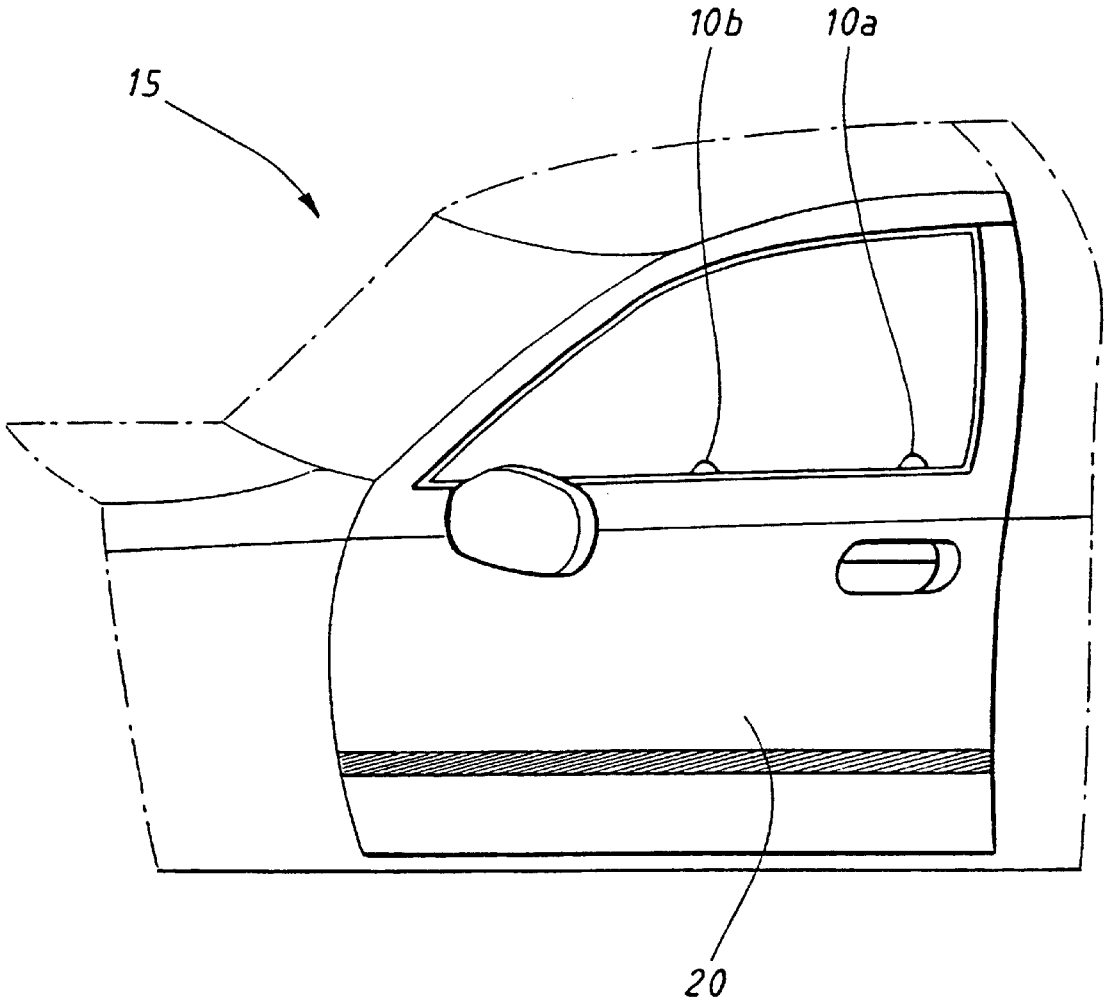
FIG. 2 is a schematic perspective view from the left side of a vehicle having a door provided with a device for indicating a two-position state according to the invention.

The indicating device may advantageously be placed in other positions than the usual location, at the rearward end of the top of a door 20 of a vehicle 15 as is shown in FIG. 2. FIG. 2 shows two alternative indicating devices—a first indicating device 10*a* placed in the traditional location, and a second indicating device 10*b* placed in the middle of the door, clearly visible for both a seated driver and a passenger. Even though two indicating devices are shown in FIG. 2, only one would be present in actual use. The indicating device may be freely placed on a door and/or on top of the dashboard, for example, since no mechanical connection exists between the indicating device and the locking mechanism of the door.

Figure 3:
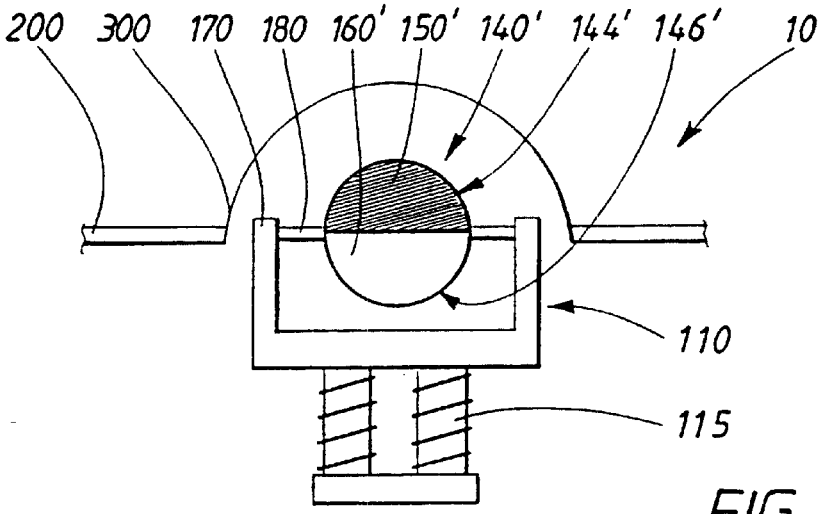
FIG. 3 is a schematic side view of one embodiment of a device for indicating a two-position state according to the invention.
Figure 4:
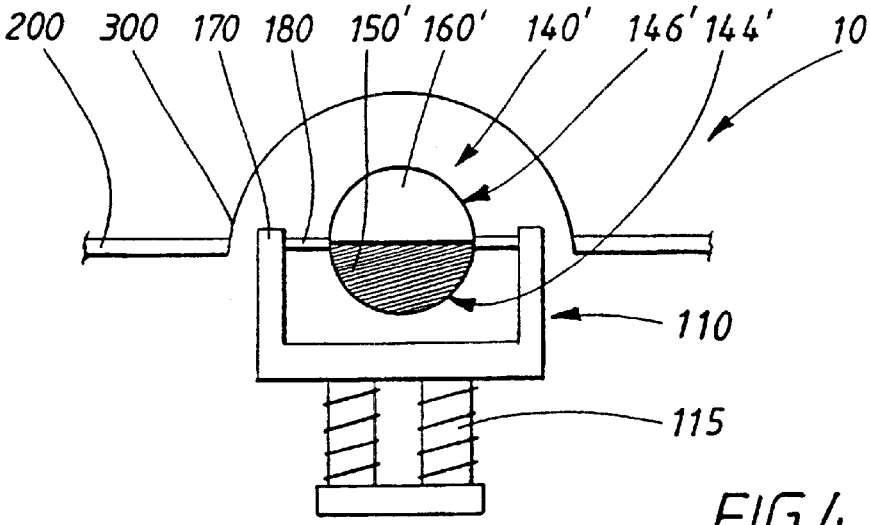
FIG. 4 is a schematic side view of one embodiment of a device for indicating a two-position state according to the invention.

According to a further embodiment of the present invention shown in FIGS. 3 and 4, the indicating device is provided with a magnetic element 140', having a first side 144' and a second side 146'. The first side 144' is provided with a first indicating means 150' and the second side 146' is provided with a second indicating means 160'. The first indicating means 150' preferably includes a first hemispherical element, and the second indicating means preferably includes a second hemispherical element. The remaining reference numerals refer to similar elements as described in FIG. 1.

Figure 5:
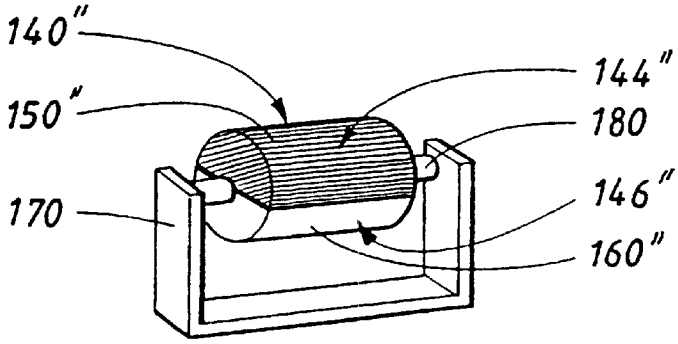
FIG. 5 is a perspective side view of one embodiment of a device for indicating a two-position state according to the invention.

According to a further embodiment of the present invention shown in FIG. 5, the indicating device is provided with a magnetic element 140", having a first side 144" and a second side 146". The first side 144" is provided with a first indicating means 150" and the second side 146" is provided with a second indicating means 160". The fist indicating means 150" preferably includes a first semi-cylindrical element and the second indicating means preferably includes a second semi-cylindrical element. The remaining reference numerals refer to similar elements as described in FIG. 1.

A general security requirement for an indicating device of this type is that it should be visible both from the inside and the outside of the vehicle. This requirement may be fulfilled using an indicating device according to the present invention.

The indicating device according to the present invention is not mechanically connected to the locking mechanism of the vehicle thereby preventing the locking mechanism from being unlocked by manipulation of the indicating device. It is also possible to arrange separate indicators for each locking function in the vehicle and/or to arrange a central indicator for all locking functions. Different indicators may be used for different doors, i.e., the first indicating means and the second indicating means may be freely chosen for different kinds of indication. Apart from doors, indicators can be used for different types of hatches, such as the rear door of a wagon or a fuel tank cover.

It is also possible to use the indicating device for indicating the state of an alarm, either with a separate indicator or in combination with a lock indicator. A separate alarm indicator may be placed in a central, clearly visible location, while a combined lock and alarm indicator may be visibly arranged near its respective lock. In the latter case, the indicator may switch between "open" and "locked/alarm on" or, alternatively, use a combination of color and fixed or flashing lights to allow indication of both "locked" and "locked/alarm on". For instance, the indicator can have a green color for indicating open state, red color for indicating locked state, and red color combined with a flashing light to indicate locked state with the alarm on.

The indicating device can either be connected to a data bus, common to all electronic systems in the vehicle, or have its own separate wiring, according to the requirements of each individual installation.

Further advantages of the indicating device according to the present invention include consuming power only while changing indicating state, greater visibility in daylight than a standard LED, providing the first and second indicating means with a combination of symbols or text and one or more colors for optimum contrast and information, and a lesser weight than the traditional lock knob connected to a metal bar. The indicator can also be provided with a type of generally known light sensor for sensing the ambient light in the vicinity of the vehicle. Under certain conditions, such as at night or in poorly lit garages, the indicator can be illuminated automatically. The latter embodiment results in an indicator that only uses power when changing indicating state, and when the ambient light is low.

The invention is not limited to the embodiments shown in the figures or described above, but can be varied within the scope of the attached claims.

What is claimed is:

1. A device for indicating a two-position state comprising:

one or more sensors, one or more bistable, magnetic switches, and a control unit, at least one electromagnet arranged in connection with each individual switch thereby enabling said switches to switch between multiple indicating positions by sending an electric pulse through said electromagnet, wherein said sensors are connected to said control unit, which in turn is connected to said switches, wherein said sensors are arranged to sense which of the multiple positions is the current state of a measured object, wherein said sensors are arranged to transmit a signal corresponding to the position of the measured object to the control unit, and wherein said control unit is arranged to transmit a signal to said electromagnet of said corresponding switch in order to update the indicated state of said switch.

2. A device according to claim 1 wherein said switches further comprise a magnetic element having a first side and a second side, wherein said first side is provided with a first indicating means and said second side is provided with a second indicating means.

3. A device according to claim 2 wherein said first indicating means and said second indicating means have different colors.

4. A device according to claim 3 wherein at least one of said first indicating means and said second indicating means has a fluorescent color.

5. A device according to claim 2 wherein said first indicating means includes a first, flat circular element and said second indicating means includes a second, flat circular element.

6. A device according to claim 2 wherein said indicating means includes a first hemispherical element and said second indicating means includes a second hemispherical element.

7. A device according to claim 2 wherein said first indicating means includes a first semi-cylindrical element and said second indicating means includes a second semi-cylindrical element.

8. A device according to claim 1 wherein said device is arranged to indicate locked and unlocked state respectively of a locking mechanism in a vehicle.

9. A vehicle including a device according to claim 1.

10. A device for indicating locked and unlocked states, respectively, of a locking mechanism in a vehicle, comprising:

one or more bistable, magnetic switches, at least one electromagnet arranged in connection with each individual switch, thereby enabling said switches to switch between multiple indicating positions by sending an electric pulse through said electromagnet, a control unit arranged to transmit a signal to said electromagnet of said corresponding switch in order to update the indicated state of said switch, and one or more sensors arranged to sense which of the multiple indicating positions is the current state of a measured object, said one or more sensors connected to said control unit, said control unit in turn connected to said one or more switches, wherein said one or more sensors are arranged to transmit a signal corresponding to the position of the measured object to the control unit.

11. The device according to claim 1 wherein the device is arranged to indicate the state of an alarm.

12. The device according to claim 11 wherein the device is arranged to indicate the state of an alarm in combination with a lock indicator.

13. The device according to claim 12 wherein the device is arranged to indicate an open, locked and locked/alarm on state.

14. The device according to claim 11 wherein the device is arranged to indicate the state of an alarm separately from a lock indicator.

* * * * *